US006202513B1

(12) United States Patent
Pan

(10) Patent No.: US 6,202,513 B1
(45) Date of Patent: Mar. 20, 2001

(54) SOCKET WRENCH

(76) Inventor: Ching-Chih Pan, 58, Ma Yuan West St., Taichung (TW)

( * ) Notice: Subject to any disclaimer, the term of this patent is extended or adjusted under 35 U.S.C. 154(b) by 0 days.

(21) Appl. No.: 09/471,732

(22) Filed: Dec. 23, 1999

(51) Int. Cl.[7] ..... B25B 13/46
(52) U.S. Cl. ..... 81/59.1; 192/44
(58) Field of Search ..... 81/59.1, 63.1; 192/44, 45, 45.1

(56) References Cited

U.S. PATENT DOCUMENTS 2,139,650 * 12/1938 Anderson et al. ..... 81/59.1
4,603,606 * 8/1986 Headon ..... 81/59.1
5,199,329 * 4/1993 Hsu ..... 81/59.1
6,053,077 * 4/2000 Huang ..... 81/59.1 X

* cited by examiner

*Primary Examiner*—D. S. Meislin

(57) ABSTRACT

A socket wrench has a handle and a box head. The box head has a rotating seat, a recess, and three concave points. The rotating seat has four protruded blocks, four control grooves, and a center hole. A rotating shaft is inserted in the center hole. The rotating shaft has a first post and a second post. An adjusting plate is inserted in the recess of the box head. The adjusting plate has two arm plates and a protrusion. The arm plates are inserted in one of the control grooves. The protrusion of the adjusting plate is inserted in one of the concave points. Two rolling cylinders and an elastic corrugation plate are disposed between the arm plates. An annular casing covers a first face of the box head. An annular cover covers a second face of the box head.

1 Claim, 4 Drawing Sheets

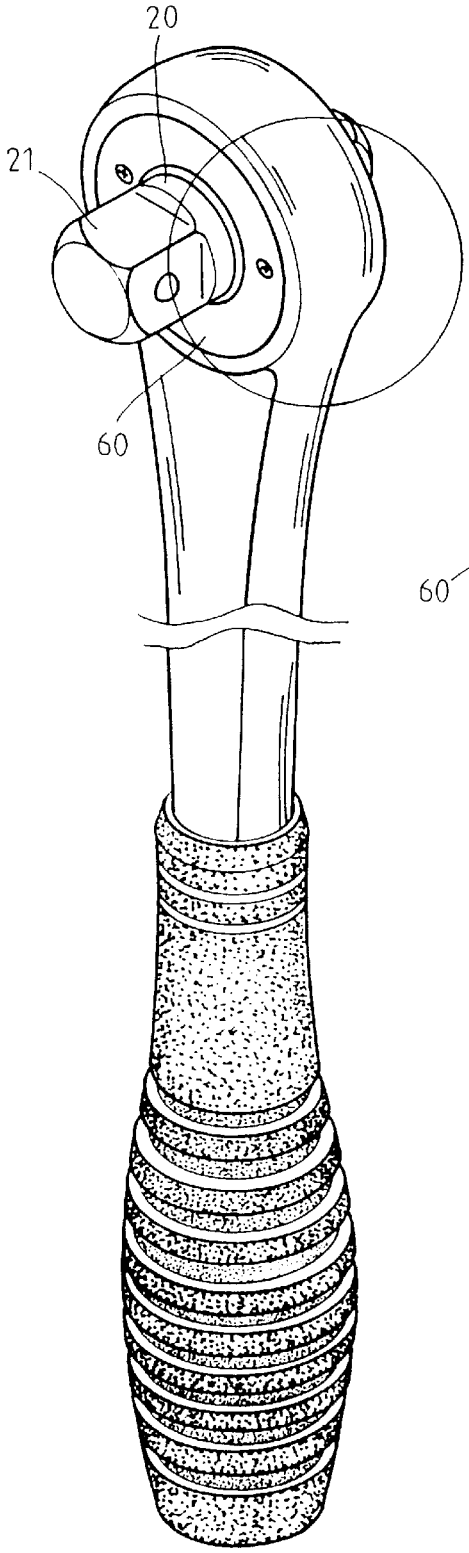
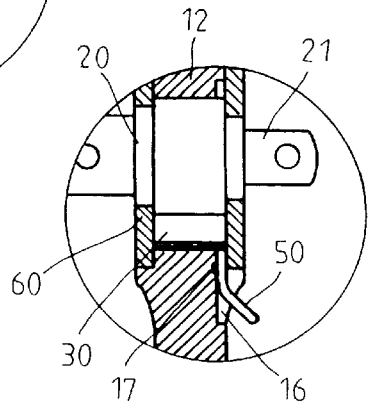
F I G. 2A
F I G. 2

SOCKET WRENCH

BACKGROUND OF THE INVENTION

The present invention relates to a socket wrench. More particularly, the present invention relates to a socket wrench which is operated and assembled easily.

A conventional socket wrench is a ratchet socket wrench. When the conventional socket wrench is operated, a dead angle will be produced so that it is not easy to operated the conventional socket wrench.

SUMMARY OF THE INVENTION

An object of the present invention is to provide a socket wrench which can be assembled easily.

Another object of the present invention is to provide a socket wrench which can be operated easily.

Accordingly, a socket wrench comprises a handle and a box head. The box head has a rotating seat, a recess, and three concave points. The rotating seat has four protruded blocks, four control grooves defined by the protruded blocks, and a center hole. A rotating shaft is inserted in the center hole of the rotating seat. The rotating shaft has a first post and a second post. An adjusting plate is inserted in the recess of the box head. The adjusting plate has two arm plates and a protrusion. The arm plates are inserted in one of the control grooves. The protrusion of the adjusting plate is inserted in one of the concave points of the box head. Two rolling cylinders and an elastic corrugation plate are disposed between the arm plates. The elastic corrugation plate is located between the rolling cylinders. An annular casing covers a first face of the box head. The annular casing has a round hole receiving the first post. An annular cover covers a second face of the box head. The annular cover has a circular hole receiving the second post.

BRIEF DESCRIPTION OF THE DRAWINGS

FIG. 2 is a perspective assembly view of a socket wrench of a preferred embodiment in accordance with the present invention;

FIG. 2A is a partially sectional view of a socket wrench of a preferred embodiment in accordance with the present invention;

DETAILED DESCRIPTION OF THE INVENTION

Figure 1:
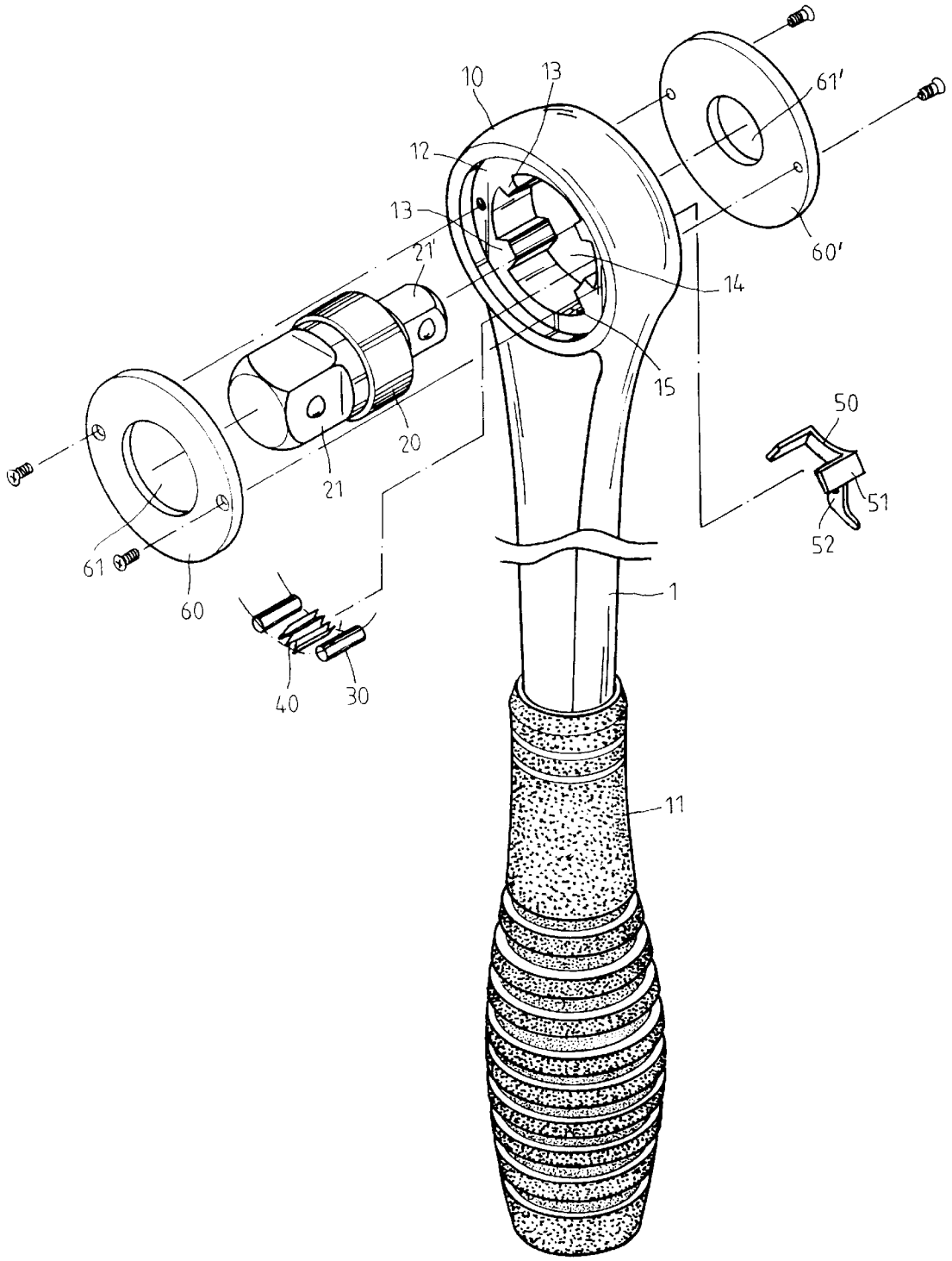
FIG. 1 is a perspective exploded view of a socket wrench of a preferred embodiment in accordance with the present invention.
Figure 3:
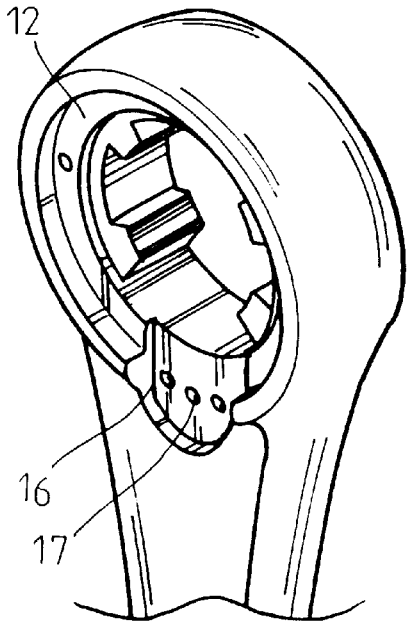
FIG. 3 is a perspective view of a box head of a socket wrench of a preferred embodiment in accordance with the present invention.
Figure 4:
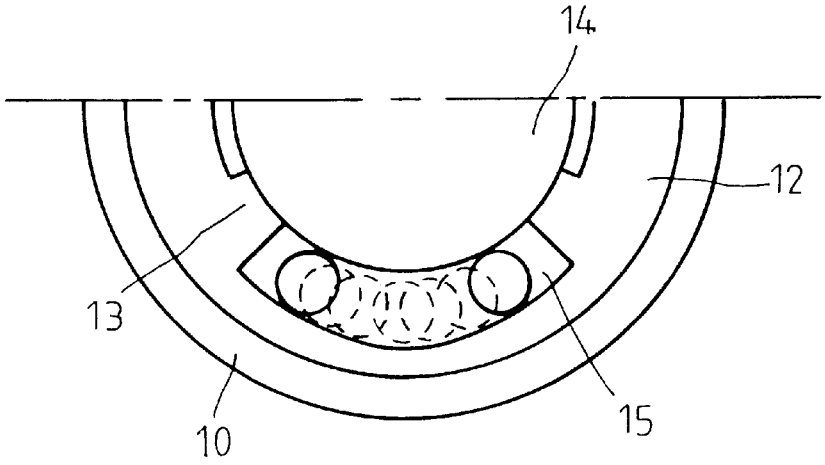
FIG. 4 is a schematic view illustrating a control groove receiving two rolling cylinders.

Referring to FIGS. 1 to 4, a socket wrench 1 comprises a handle 11 and a box head 10.

The box head 10 has a rotating seat 12, a recess 16, and three concave points 17.

The rotating seat 12 has four protruded blocks 13, four control grooves 15 defined by the protruded blocks 13, and a center hole 14.

A rotating shaft 20 is inserted in the center hole 14 of the rotating seat 12. The rotating shaft 20 has a first post 21 and a second post 21'.

An adjusting plate 50 is inserted in the recess 16 of the box head 10. The adjusting plate 50 has two arm plates 51 and a protrusion 52. The arm plates 51 are inserted in one of the control grooves 15. The protrusion 52 of the adjusting plate 50 is inserted in one of the concave points 17 of the box head 10.

Two rolling cylinders 30 and an elastic corrugation plate 40 are disposed between the arm plates 51. The elastic corrugation plate 40 is located between the rolling cylinders 30.

An annular casing 60 covers a first face of the box head 10. The annular casing 60 has a round hole 61 receiving the first post 21.

An annular cover 60' covers a second face of the box head 10. The annular cover 60' has a circular hole 61' receiving the second post 21'.

Figure 5:
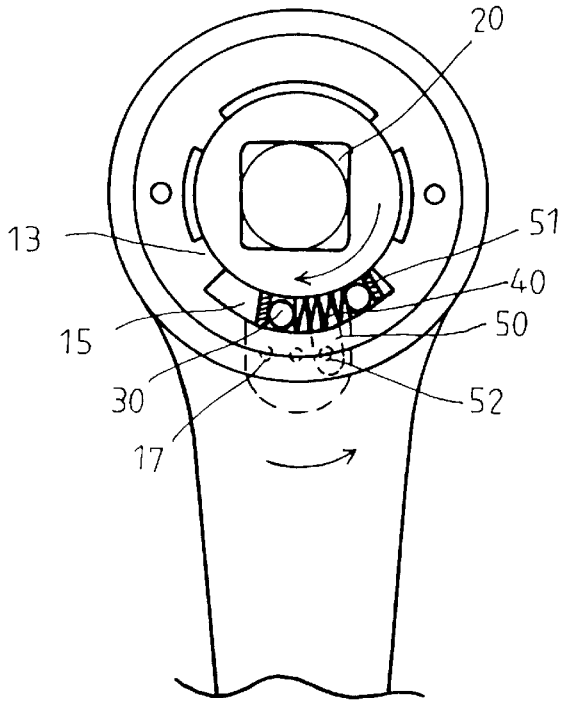
FIG. 5 is a schematic view illustrating an operation of a socket wrench of a preferred embodiment in accordance with the present invention.

Referring to FIG. 5, the adjusting plate 50 is moved rightward. The rotating shaft 20 is blocked by the right rolling cylinder 30 so that the rotating shaft 20 cannot rotate counterclockwise. Then the rotating shaft 20 can rotate clockwise.

Figure 6:
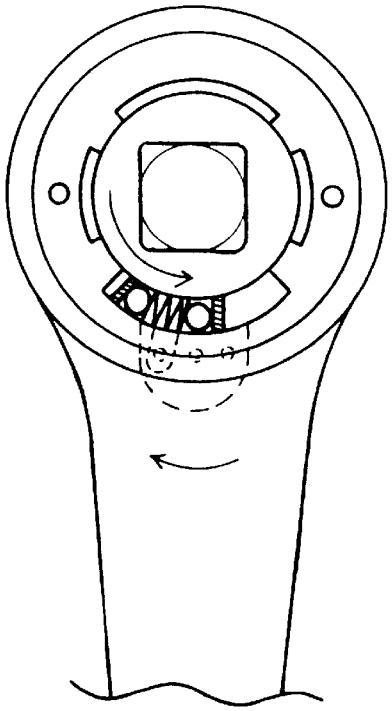
FIG. 6 is another schematic view illustrating an operation of a socket wrench of a preferred embodiment in accordance with the present invention.

Referring to FIG. 6, the adjusting plate 50 is moved leftward. The rotating shaft 20 is blocked by the left rolling cylinder 30 so that the rotating shaft 20 cannot rotate clockwise. Then the rotating shaft 20 can rotate counterclockwise.

The present invention has the following advantages. A residual clearance is eliminated, so the socket wrench will not produce a dead angle. A large torsion will occur while the rotating shaft rotates clockwise or rotates counterclockwise. The present invention provides the adjusting plate so that the rotating shaft can rotate clockwise or counterclockwise. The size of the first post is different from the size of the second post, so the socket wrench fits various sizes of sleeves.

The present invention is not limited to the above embodiment but various modification thereof may be made. Furthermore, various changes in form and detail may be made without departing from the scope of the present invention.

I claim:

1. A socket wrench comprises:

a handle and a box head, the box head having a rotating seat, a recess, and three concave points, the rotating seat having four protruded blocks, four control grooves defined by the protruded blocks, and a center hole, a rotating shaft inserted in the center hole of the rotating seat, the rotating shaft having a first post and a second post, an adjusting plate inserted in the recess of the box head, the adjusting plate having two arm plates and a protrusion, the arm plates inserted in one of the control grooves, the protrusion of the adjusting plate inserted in one of the concave points of the box head, two rolling cylinders and an elastic corrugation plate disposed between the arm plates, the elastic corrugation plate located between the rolling cylinders, an annular casing covering a first face of the box head, the annular casing having a round hole receiving the first post, an annular cover covering a second face of the box head, the annular cover having a circular hole receiving the second post.

* * * * *